US010696522B2

(12) United States Patent
Bitzi et al.

(10) Patent No.: US 10,696,522 B2
(45) Date of Patent: Jun. 30, 2020

(54) METHOD FOR POST-PROCESSING A SURFACE STRUCTURE OF SHAFT MATERIAL

(71) Applicant: INVENTIO AG, Hergiswil (CH)

(72) Inventors: Raphael Bitzi, Lucerne (CH); Karl Weinberger, Immensee (CH)

(73) Assignee: INVENTIO AG, Hergiswil NW (CH)

( * ) Notice: Subject to any disclaimer, the term of this patent is extended or adjusted under 35 U.S.C. 154(b) by 402 days.

(21) Appl. No.: 15/534,784

(22) PCT Filed: Dec. 14, 2015

(86) PCT No.: PCT/EP2015/079554
§ 371 (c)(1),
(2) Date: Jun. 9, 2017

(87) PCT Pub. No.: WO2016/096698
PCT Pub. Date: Jun. 23, 2016

(65) Prior Publication Data

US 2017/0341910 A1 Nov. 30, 2017

(30) Foreign Application Priority Data

Dec. 15, 2014 (EP) ..... 14198046

(51) Int. Cl.
*B66B 1/12* (2006.01)
*B66B 19/00* (2006.01)
(Continued)

(52) U.S. Cl.
CPC ..... *B66B 19/007* (2013.01); *B05D 1/12* (2013.01); *B66B 1/3492* (2013.01);
(Continued)

(58) Field of Classification Search
CPC .... B66F 9/0755; B66F 11/048; B66B 1/3492; B66B 5/0018; B66B 5/0087; B66B 5/02;
(Continued)

(56) References Cited

U.S. PATENT DOCUMENTS 3,139,352 A * 6/1964 Coyner ..... B05D 1/32 427/259
2002/0104716 A1* 8/2002 Zaharia ..... B66B 1/3492 187/394
(Continued)

FOREIGN PATENT DOCUMENTS

CN 101888964 A 11/2010
CN 101734545 B 6/2013
(Continued)

*Primary Examiner* — Marlon T Fletcher
(74) *Attorney, Agent, or Firm* — William J. Clemens; Shumaker, Loop & Kendrick, LLP

(57) ABSTRACT

A method for refinishing a surface structure of shaft material of an elevator, which extends along a shaft, enables the use of image data to determine an absolute position and/or speed of an elevator car. The elevator includes the elevator car, which is movable in the shaft, a camera, which is arranged at the elevator car and generates the image data from the surface structure, and an evaluating unit, which determines the absolute position and/or the speed of the elevator car from the image data. The surface structure is refinished at least locally in order to increase a distinctiveness of the surface structure in the image data. The shaft material can be, for example, a guide rail, a fastening element of the guide rail, or a shaft wall.

15 Claims, 3 Drawing Sheets

(51) Int. Cl.

| | |
|---|---|
| ***B66B 1/34*** | (2006.01) |
| ***B05D 1/12*** | (2006.01) |
| ***B66B 5/00*** | (2006.01) |
| ***B66B 7/02*** | (2006.01) |
| ***B66B 9/00*** | (2006.01) |
| ***B66B 11/00*** | (2006.01) |

(52) U.S. Cl.
CPC ..... *B66B 5/0018* (2013.01); *B66B 7/02* (2013.01); *B66B 7/022* (2013.01); *B66B 7/023* (2013.01); *B66B 9/00* (2013.01); *B66B 11/0005* (2013.01)

(58) Field of Classification Search
CPC ..... B66B 25/006; B66B 11/0246; C23C 18/2066; C23C 18/30; C23C 26/02
See application file for complete search history.

(56) References Cited

U.S. PATENT DOCUMENTS

2007/0062763 A1* 3/2007 Shiratsuki ..... B66B 1/3492 187/394
2009/0013517 A1* 1/2009 Benz ..... B23P 6/00 29/402.13
2009/0142600 A1* 6/2009 Dogan ..... B05D 1/36 428/422.8
2013/0001023 A1* 1/2013 Leutenegger ..... B66B 1/3492 187/394
2016/0139269 A1* 5/2016 Yamazaki ..... G01S 17/88 356/4.01
2017/0341910 A1* 11/2017 Bitzi ..... B05D 1/12
2017/0355554 A1* 12/2017 Eleid ..... G06F 3/0484
2017/0355558 A1* 12/2017 Khalil ..... B66B 5/0031
2018/0297260 A1* 10/2018 Cappa ..... B23K 35/3086
2019/0062119 A1* 2/2019 Fauconnet ..... B66B 5/0012

FOREIGN PATENT DOCUMENTS

| | | | |
|---|---|---|---|
| EP | 1178001 | A1 | 2/2002 |
| EP | 1232988 | A1 | 8/2002 |
| JP | S6168073 | U | 5/1986 |
| JP | H09124238 | A | 5/1997 |

* cited by examiner

METHOD FOR POST-PROCESSING A SURFACE STRUCTURE OF SHAFT MATERIAL

FIELD

The invention relates to the field of determining an absolute position of an elevator car by means of evaluation of a surface structure of shaft material; in particular, the invention relates to a method for refinishing this surface structure, to shaft material which is refinished in accordance with the method and to an elevator with such refinished shaft material.

BACKGROUND

Patent Specification EP 1 232 008 B1 shows an elevator installation with an absolute positioning system. This absolute positioning system comprises a camera, which is arranged at an elevator car and is used for the purpose of generating images of shaft material or the surface structure of this shaft material. Regarded as shaft material are not only guide rails, shaft doors and other elevator components, which are arranged in stationary position in the shaft, but also shaft walls bounding the shaft. The shaft material forms, in its entirety, a surface structure which extends substantially along the travel path of the elevator car. This surface structure continuously changes so that each generated image is unique and can serve as an indicator for a position of the elevator car. The camera generates references images of the surface structure in a learning travel. An evaluating unit connected with the camera assigns to these reference images a position in the shaft and files the references images as well as the associated position values on a storage medium. In normal operation, an absolute position of the elevator car can now be determined by the evaluating unit on the basis of comparison of the images, which are continuously generated by the camera, with the filed reference images.

In the absolute positioning system according to EP 1 232 008 B1, by comparison with other absolute positioning systems there is no need for an additional code carrier for investigating the position of the elevator car. Nevertheless, in practice such an absolute positioning system could never be successful, since determination of the position of the elevator car on the basis of evaluation of the surface structure has proved to be insufficiently reliable.

SUMMARY

It is therefore an object of the invention to further improve such an absolute positioning system, which is based on recognition of the surface structure of shaft material, in particular to further increase the reliability of the absolute positioning system.

According to the invention this object is fulfilled by a method for refinishing a surface structure of shaft material of an elevator. This surface structure extends along a shaft. In that case, the elevator comprises at least one elevator car which is movable in the shaft, a camera which is arranged at the elevator car and produces image data of the surface structure and an evaluating unit which determines an absolute position and/or speed of the elevator car on the basis of the image data. The method is distinguished by the fact that the surface structure is refinished at least locally in order to increase distinctiveness of the surface structure. The surface structure is preferably refinished subsequently to a process of basic formation of the shaft material.

In the following, use of the expression "absolute position" shall analogously also include a speed of the elevator car derivable from the values of the absolute position.

The term "camera" shall be interpreted widely here and embrace all image-detecting systems which can represent a surface structure and shall embrace, apart from conventional cameras, also, for example, infrared cameras, scanners, X-ray recording apparatus, ultrasonic image generating systems and the like.

By "shaft material" there shall be understood here all components, which are fastened in or to the shaft, of the elevator as well as the shaft walls bounding the shaft. Components of the elevator which are fastened in or to the shaft concern, for example, guide rails, shaft doors and the fastening elements thereof. By "fastening elements" there shall also be understood here subsidiary components such as fastening screws, clamping plates and the like.

Such components as a shaft wall, a guide rail or a fastening element of a guide rail are typically produced by a basic forming process. Thus, for example, guide rails are basically formed from cold-drawn, hot-rolled, cold-rolled or welded-together sections. A shaft wall typically receives its basic shape in a concreting process. Fastening elements, such as clamping plates, which are fastened to the shaft wall and which in that case fixedly clamp the guide rail to the shaft wall are basically formed from, for example, bent sheet metal plates.

The surface structure forms a two-dimensional pattern or a three-dimensional structure which can be evaluated by way of image. The surface structure is locally distinctive to a greater or lesser extent. Locations with a surface structure of high distinctiveness facilitate evaluation by way of image, since the pattern of the surface structure is particularly characteristic or unique.

Thereagainst, there are also locations with a surface structure of lesser distinctiveness. Such locations are difficult to evaluate by way of image, since these locations of the surface structure lack characteristics and thus uniqueness. Such locations with a surface structure of lesser distinctiveness are present at, for example, brightly polished metallic surfaces which appear as a homogenous surface in the image. Several successive images, which are recorded during vertical travel of the elevator car or the camera, of such a location can be distinguished from one another only with difficulty, so that association with references images is made difficult. This can lead to erroneous evaluation in the evaluating unit.

In addition, in the case of the surface structure of a shaft wall it is locally possible, due to a casing element with a particularly smooth surface or a repeating pattern used in concreting of the shaft wall, that the resulting distinctiveness of the surface structure is relatively low.

Moreover, a material change in the surface of shaft material, particularly in connection with lighting of the surface structure for better detection of the same by way of image by the camera, can be accompanied by a change in the reflection characteristic of the detected surface structure. Depending on the respective reflection characteristic, this can lead to over-exposure of the camera. In that case, detected over-exposed image data may be incapable of adequate evaluation for determination of the absolute position, since due to the over-exposure the distinctiveness of the surface structure, although possibly present, is no longer detectable by way of image.

That is why refinishing of the surface structure, particularly increasing the distinctiveness of the surface structure with accompanying reduction in the reflection characteristic of the surface, has a positive effect on the reliability of determination of the absolute position of the elevator car.

If at least those locations of the surface structure which have a low level of distinctiveness are refinished, then a surface structure with a continuous high level of distinctiveness results. Of course, the surface structure can obviously also be continuously refinished. Consequently, a surface structure with a continuous high level of distinctiveness similarly results.

Thereagainst, the surface structure of a guide rail can be readily mechanically refinished with relatively little effort at the time of its manufacture. The surface structure of a guide rail can therefore be continuously refinished in relatively simple manner. This is of even greater advantage, since the guide rails extend continuously along the shaft or along the travel range of the elevator car. Of course, a guide rail already fastened to a shaft wall can subsequently undergo refinishing of the surface structure. In that regard, a refinishing of the surface structure locally oriented specifically to the regions of the surface structure with a lesser distinctiveness might be preferred.

Numerous processing methods are available for shaft material with a metallic surface in order to refinish the surface structure. These processing methods can be divided into several categories. These are, inter alia, processing methods involving machining and not involving machining.

Machining processing methods comprise, for example, grinding, engraving, blasting and brushing, whilst non-machining processing methods comprise, for example, stamping, etching, hammering and laser marking of metallic surfaces of shaft material. The two mentioned groups of processing methods are available particularly in mechanical refinishing of the surface structure and accordingly particularly in continuous refinishing of a surface structure. However, it is also conceivable to use processing methods such as grinding or brushing on site for local increase in the distinctiveness of the surface structure.

A further group of processing methods relates to layer-coating processing methods such as, for example, the application of hammer-finish paint, powder coating, deposition, particularly spraying-on of a three-dimensional structure by means of a structuring spray, or deposition, particularly spraying-on of substantially two-dimensional patterns by means of a pattern spray. Falling in the category of two-dimensional patterns are the afore-mentioned hammer-finish paint or also paints applied in a single color, two colors or multiple colors, particularly also fluorescent or phosphorizing paints which give a characteristic pattern.

In processing methods in which the surface structure undergoes build-up of a three-dimensional structure such as, for example, in all material-removing processing methods or in deposition, particularly the spraying-on of a structure, the achieved surface structure has a mean roughness value Ra, preferably between 10 and 1000.

This form of refinishing of the surface structure is suitable not only for metallic and non-metallic surfaces of shaft material, but also for shaft walls. In addition, layer-coating processing methods can be used not only for local, but also for continuous refinishing for increasing the distinctiveness of a surface structure of a shaft wall. Since the surface structure of a shaft wall can be mechanically refinished only with greater cost, in this case it is appropriate to refinish, in particular, the surface structure of the shaft wall only locally.

In a further aspect, the invention relates to elevator components, particularly a guide rail, or a fastening element which has been refinished according to the above-described method.

A guide rail is typically formed as a T-section and designed for the purpose of guiding an elevator car or a counterweight. Such a T-section usually comprises a base plate from which a guide flange centrally protrudes at a right angle. A side of the base plate facing the guide flange preferably has a surface structure which is refinished in accordance with the afore-described method.

In addition, guide rails formed as a T-section usually have a web forming a transition between the base plate and the guide flange. As an alternative to refinishing the base plate, a surface structure of this web can also be refinished in accordance with the afore-described method.

The fastening element is designed for the purpose of fastening a guide rail to the shaft wall. The fastening element preferably has a surface structure which is refinished in accordance with the afore-described method. The fastening means can be constructed as, for example, a clamping plate.

In a still further aspect the invention relates to an elevator with an elevator car movable in a shaft. Moreover, the elevator comprises shaft material, which has a surface structure extending along the travel path of the elevator car, a camera, which is arranged at the elevator car and generates image data from a surface structure, and an evaluating unit, which determines an absolute position of the elevator car on the basis of the image data. The shaft material preferably comprises a guide rail and/or a fastening element which are constructed in accordance with the preceding description and/or a shaft wall, the surface structure of which was refinished in accordance with the above method, particularly by means of a layer-coating processing method.

DESCRIPTION OF THE DRAWINGS

Preferred forms of embodiment of the invention are explained in more detail in the following description by way of the accompanying drawings, in which.

DETAILED DESCRIPTION

Figure 2:
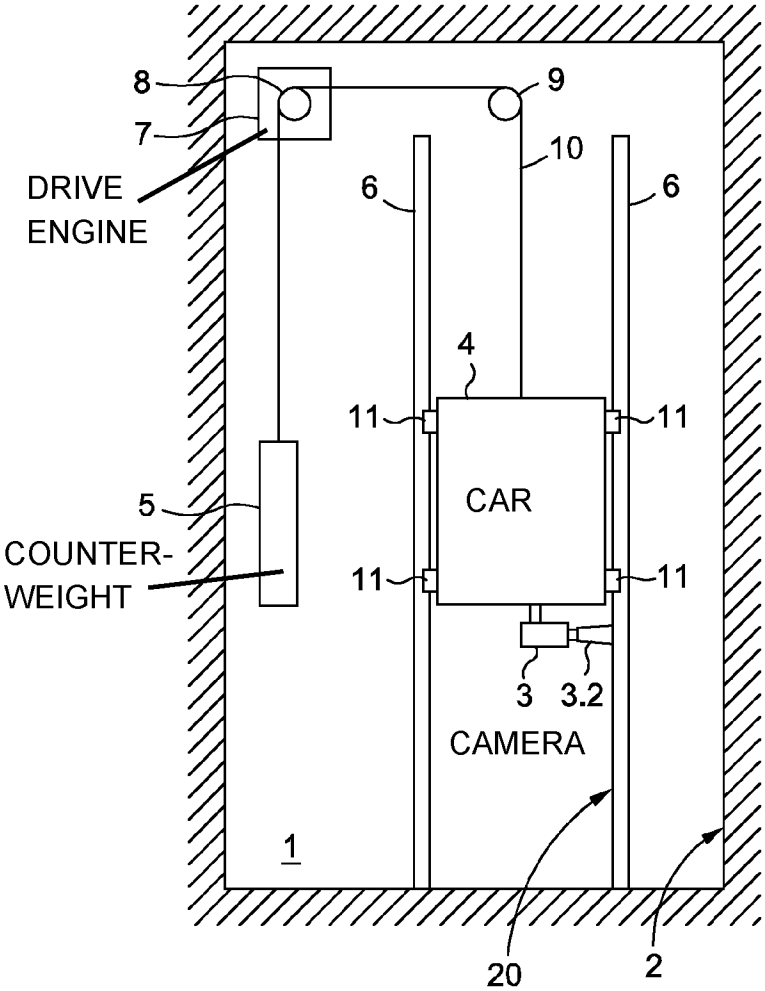
FIG. 2 shows, in a strongly schematic illustration, an exemplifying embodiment of an elevator installation with a camera as part of an absolute positioning system, which generates images of a surface structure of a guide rail.
Figure 1:
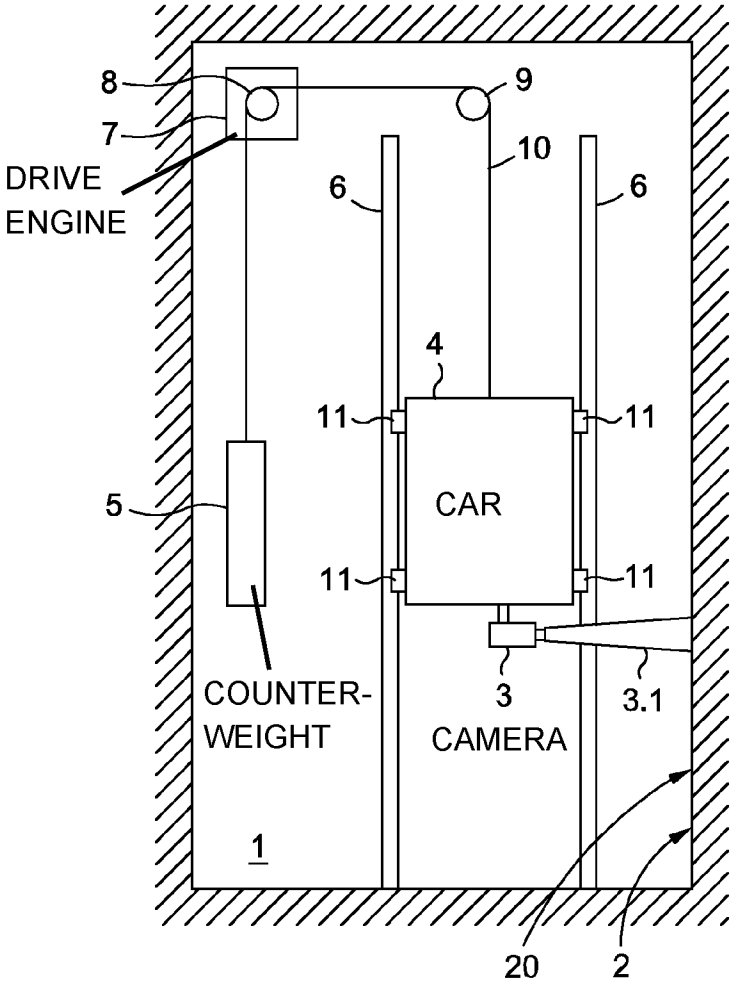
FIG. 1 shows, in a strongly schematic illustration, an exemplifying embodiment of an elevator installation with a camera as part of an absolute positioning system, which generates images of a surface structure of a shaft wall.

FIG. 1 and FIG. 2 show an elevator with an elevator car 4 which is movable in a shaft 1 along guide rails 6. In that case, the elevator car 4 is guided at the guide rail 6 by way of guide elements 11 such as, for example, guide shoes. The elevator car 4 is suspended at a first end of the support means 10 in a suspension ratio of 1:1. The expert can, of course, also select a suspension ratio, which differs therefrom, of 2:1 or higher. In order to compensate for the weight force of the elevator car 4 a counterweight 5, which is suspended at a second end of the support means 10, is provided.

In addition, a drive unit comprising at least one drive engine 7 and a drive pulley 8 driven by the drive engine is provided. The support means 10 runs over the drive pulley 8 and is operatively connected therewith so that a drive moment of the drive engine 7 is transmissible to the support means 10 by way of the drive pulley 8. In addition, the support means 10 runs over a deflecting roller 9.

Moreover, the elevator comprises a camera 3 which is arranged at the elevator car 4. The camera 3 is part of an absolute positioning system and generates images of the surface structure 20 from shaft material 2, 6, 12. The camera 3 records reference images, which are filed in a storage medium (not illustrated), of the surface structure 20 in a learning travel. In the case of travel during normal operation of the elevator the camera 3 generates continuous images of the surface structure 20. These images are evaluated in an evaluating unit (not illustrated). This evaluation includes comparison between the previously filed reference images, which are associated with a position in the shaft 1, with the images continuously produced during travel of the elevator car 4. In that case, the evaluating unit determines an absolute position of the elevator car 4.

In FIG. 1, the recording region 3.1 of the camera 3 is directed towards a shaft wall 2 bounding the shaft 1. Accordingly, the camera 3 generates images of the surface structure 20 of the shaft wall 2, which are evaluated by the evaluating unit.

If the level of distinctiveness of the surface structure 20 of the shaft wall 2 is too low at least locally and does not allow reliable positional determination, then the surface structure 20 of this location can be refinished. In the case of a shaft wall, the refinishing can be realized particularly simply by means of layer-coating processing methods.

In FIG. 2, the recording region 3.2 of the camera 3 is directed towards a guide rail 6. Accordingly, the camera 3 generates images of the surface structure 20 of the guide rail 6, which are evaluated by the evaluating unit.

There are numerous ways of processing the surface structure 20 in the case of a metallic surface such as, for example, a guide rail 6. Thus, use can be made not only of material-removing and non-material-removing processing methods, but also layer-coating methods. Since guide rails 6 are prepared by machine, refinishing of the surface structure 20 can preferably be carried out right at the time of production of the guide rail 6, particularly continuously over the entire length of the guide rail 6 in relatively simple manner.

Figure 2A:
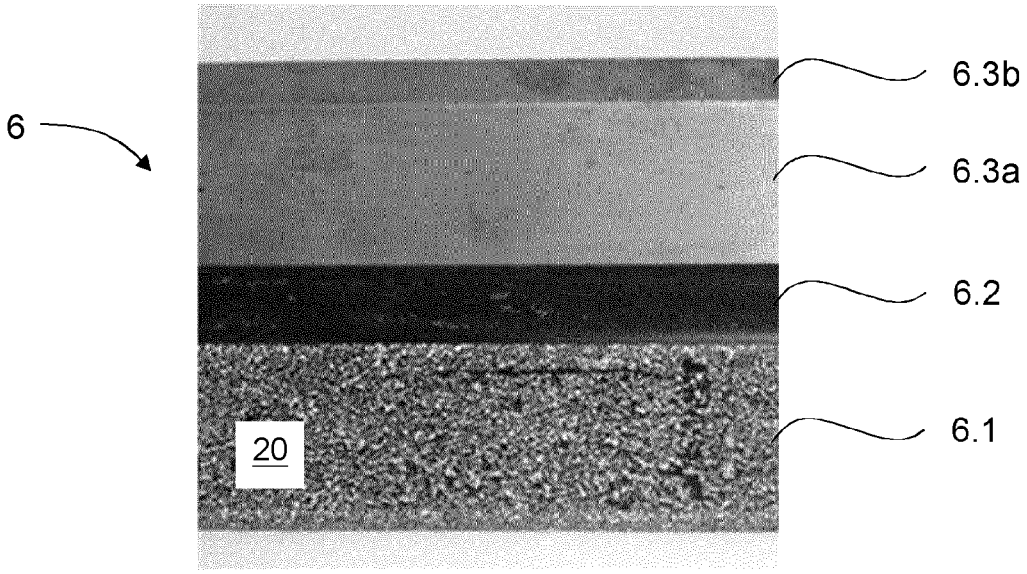
FIG. 2A shows an exemplifying embodiment of refinishing in accordance with the invention of the surface structure by means of spraying a structure onto a guide rail.
Figure 2B:
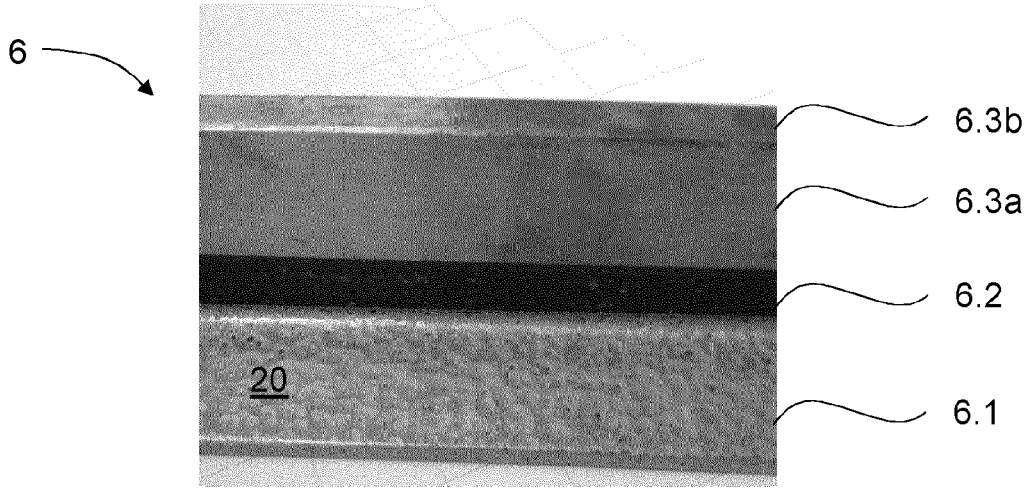
FIG. 2B shows an exemplifying embodiment of refinishing in accordance with the invention of the surface structure by means of coating a hammer-finish paint on a guide rail.

Two examples of surface structures 20, which were refinished by two different processing methods, on a guide rail 6 are shown in FIGS. 2A and 2B.

In the case of FIG. 2A, the surface structure 20 of the base plate 6.1 of the guide rail 6 was refinished by a sprayed-on structure. A guide flange, which has a guide surface 6.3*a* and an end surface 6.3*b*, is connected centrally with the base plate 6.1 at a right angle. The web 6.2 forms a transition between the base plate 6.1 and the guide flange 6.3. The web 6.2 appears black in the image of FIG. 2A. In the illustrated example, only the base plate is refinished with the sprayed-on structure. Alternatively or additionally thereto the surface structure 20 of the web 6.2 might also be refinished. In the illustrated example the sprayed-on surface structure 20 extends continuously along the entire guide rail 6. In that case, a three-dimensional surface structure 20 is produced.

The material of the sprayed-on structure preferably comprises at least one substance from the group consisting of nitro-cellulose binder, vinyl copolymer and polyurethane synthetic resin dispersion.

FIG. 2B shows a surface structure 20 refinished with a hammer-finish paint. In this example as well, only the surface structure 20 of the base plate 6.1 is refinished. Neither the surface structure 20 of the web 6.2 nor that of the guide flange 6.3*a*, 6.3*b* was refinished. However, here as well the web 6.2 might also additionally or alternatively be refinished with a hammer-finish paint. Here, too, the applied hammer-finish paint preferably extends continuously along the entire guide rail 6.

The hammer-finish paint comprises at least one element from the group consisting of aluminum flakes, mica, bronze and silicon oil in order to impart individual two-dimensional surface patterns to the hammer-finish paint.

Figure 2C:
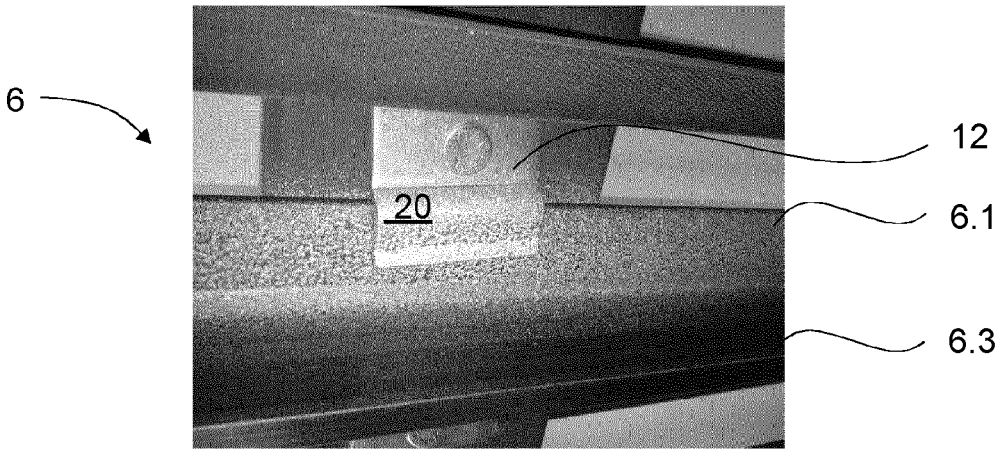
FIG. 2C shows an exemplifying embodiment of refinishing in accordance with the invention of the surface structure by means of spraying a structure onto a guide rail and a fastening element.

FIG. 2C shows a further embodiment of a sprayed-on structure. In this embodiment the structure was sprayed onto a guide rail 6, particularly onto the base plate 6.1 thereof and onto a fastening element 12 of the guide rail 6. The illustrated fastening element 12 is here formed as a clamping plate. The expert can, of course, also use other forms of suitable fastening elements 12, which in the case of insufficient distinctiveness of the surface structure 20 can be treated in correspondence with the processing method shown here.

The invention is not restricted to the illustrated examples. Rather, use can also be made of the processing methods mentioned in the introduction in order to increase distinctiveness of the surface structure 20. In addition, any shaft material can make a contribution to the surface structure 20 to be evaluated, even if only locally.

In accordance with the provisions of the patent statutes, the present invention has been described in what is considered to represent its preferred embodiment.

However, it should be noted that the invention can be practiced otherwise than as specifically illustrated and described without departing from its spirit or scope.

The invention claimed is:

1. A method for determining an absolute position and/or speed of an elevator car that is movable in an elevator shaft, the method comprising the steps of:

identifying a surface structure of an elevator shaft material in the elevator shaft for determining the absolute position and/or speed of the elevator car in the elevator shaft, the surface structure extending in the shaft along a travel path of the elevator car;

selecting at least one location on the surface structure for refinishing;

refinishing the at least one location by at least one of mechanical processing and layer-coating processing to increase a distinctiveness of the at least one location in image data;

arranging a camera at the elevator car; and generating the image data of the at least one location on the surface structure from the camera for use by an evaluating unit to determine at least one of the absolute position and the speed of the elevator car based upon the image data.

2. The method according to claim 1 wherein the at least one location is an entirety of the surface structure.

3. The method according to claim 1 wherein the at least one location includes all of the surface structure that lacks distinctiveness detectable in the image data prior to performing the refinishing step.

4. The method according to claim 1 wherein the surface structure is refinished subsequently to a basic process of forming the shaft material.

5. The method according to claim 1 wherein the surface structure is part of at least one of a wall of the elevator shaft, a guide rail in the elevator shaft and a fastening element in the elevator shaft.

6. The method according to claim 1 including performing the refinishing step by spraying-on a three-dimensional structure using a structuring spray.

7. The method according to claim 6 wherein the three-dimensional structure is at least one of a nitro-cellulose binder, a vinyl copolymer and a polyurethane synthetic resin dispersion.

8. The method according to claim 1 including performing the refinishing step by spraying-on a two-dimensional pattern using a pattern spray.

9. The method according to claim 8 wherein the two-dimensional pattern is formed from a hammer-finish paint that includes at least one of aluminum flakes, mica, bronze and silicon oil.

10. The method according to claim 1 including performing the refinishing step by a machining processing method.

11. The method according to claim 10 wherein the machining processing method is at least one of grinding, engraving, blasting and brushing.

12. The method according to claim 1 including performing the refinishing step by a non-machining processing method.

13. The method according to claim 12 wherein the non-machining processing method is at least one of stamping, etching, hammering and laser marking.

14. An elevator comprising:

an elevator car movable in a shaft, the shaft including a shaft material that has a surface structure extending along a travel path of the elevator car;

a camera arranged at the elevator car for generating image data from the surface structure wherein an evaluating unit determines an absolute position of the elevator car in the shaft based upon the image data; and wherein the shaft material is an elevator component refinished, at least locally, by performing the method according to claim 1.

15. The elevator according to claim 14 wherein the elevator component is one of a wall of the shaft, a guide rail for the elevator car, and a fastening element for the guide rail.

* * * * *